US007283099B2

(12) United States Patent
Na

(10) Patent No.: US 7,283,099 B2
(45) Date of Patent: Oct. 16, 2007

(54) BUILT-IN ANTENNA MODULE OF WIRELESS COMMUNICATION TERMINAL

(75) Inventor: Gi Lyong Na, Kyungki-Do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 11/531,571

(22) Filed: Sep. 13, 2006

(65) Prior Publication Data

US 2007/0057856 A1 Mar. 15, 2007

(30) Foreign Application Priority Data

Sep. 14, 2005 (KR) ..... 10-2005-0085709

(51) Int. Cl.
*H01Q 1/24* (2006.01)

(52) U.S. Cl. ..... 343/702

(58) Field of Classification Search ..... 343/702, 343/873, 700 MS, 906; 29/600
See application file for complete search history.

(56) References Cited

U.S. PATENT DOCUMENTS 4,546,357 A * 10/1985 Laughon et al. ..... 343/702
5,572,223 A * 11/1996 Phillips et al. ..... 343/702

* cited by examiner

*Primary Examiner*—Tho Phan
(74) *Attorney, Agent, or Firm*—Lowe Hauptman Ham & Berner

(57) ABSTRACT

A built-in antenna module of a wireless communication terminal is provided. In the antenna module, a substrate is disposed inside a terminal body and has a plurality of electronic parts mounted therein. At least one radiator rib is integrally extended from the terminal body along a predetermined pattern in accordance with properties of the antenna. A radiator line is made of a conductive elastomer which is dispensed and coated onto an upper end of the radiator rib. The radiator line has an end electrically connected to a feeding part of the substrate. The invention simplifies a process for manufacturing the antenna module, thereby improving work productivity and saving manufacturing costs. The invention also allows the antenna to be modified in design more flexibly and the terminal product to be miniaturized.

11 Claims, 5 Drawing Sheets

(a)

(b)

BUILT-IN ANTENNA MODULE OF WIRELESS COMMUNICATION TERMINAL

CLAIM OF PRIORITY

This application claims the benefit of Korean Patent Application No. 2005-85709 filed on Sep. 14, 2005 in the Korean Intellectual Property Office, the disclosure of which is incorporated herein by reference.

BACKGROUND OF THE INVENTION

1. Field of the Invention

The present invention relates to a built-in antenna module for a wireless telecommunication terminal, more particularly, in which a radiator for transmitting/receiving a signal is formed of a conductive elastomer dispensed on a radiator rib that is integrally injection-molded on a casing of a terminal body, by which the antenna can be assembled easily and quickly and reduced in its occupying space to enhance miniaturization.

2. Description of the Related Art

In general, a wireless communication terminal refers to a portable communication device capable of transmitting/receiving voices, texts and image data through wireless communication. The examples include a personal communication service (PCS) terminal, a Personal Digital Assistant (PDA), a smart phone, a next-generation mobile communication (IMT-2000) terminal, a wireless LAN terminal and the like.

The wireless communication terminal adopts a helical antenna or a dipole antenna to enhance its transmission and reception sensitivity. These are external antennas, which thus are extended out of the wireless terminal.

The external antennas are advantageously characterized by non-directional radiation. At the same time, they are disadvantageously prone to damage by external force, hardly portable and designed with poor aesthetic appearance.

To overcome such a problem, plate-shaped built-in antennas such as a micro-strip patch antenna or inverted F-type antenna have been recently adopted in the wireless communication terminal since they can be installed in the terminal without being extended outward.

FIG. 1 is an exploded view illustrating a conventional built-in antenna which is provided in a wireless communication terminal. FIG. 2 is a perspective view illustrating a conventional built-in antenna module which is assembled onto a lower casing of a wireless communication terminal. As shown, the antenna module 1 includes a radiator 10 and a base 20.

The radiator 10 is made of a conductive material such as a conductive metal so as to transmit and receive a radio wave signal from a base station. To form the radiator 10, a plate-shaped material is pressurized/perforated in a predetermined pattern.

The base 20 is made of a non-conductive material which is molded of a non-conductive resin. The base 20 is a fixed structure mounted on a substrate M.

The base 20 has a plurality of assembly pillars 22 on an upper surface thereof into which assembly holes 12 of the radiator 10 are inserted. This allows the radiator 10 to be fixedly disposed on an outer surface of the base 20. Also, the base 20 has a plurality of lower assembly steps 24 formed on a lower end thereof corresponding to lower assembly holes 13 on the substrate M.

The substrate M is mounted on a lower casing 109 which constitutes a terminal body together with an upper casing 108. A feeding part 15 of the radiator mounted on the base 20 is electrically connected to the base M.

However, in such a conventional antenna module 1, to form the radiator 10 in a predetermined pattern, a plate-shaped material is pressurized and then perforated in a predetermined pattern. The radiator 10 processed as just described should be manually assembled onto the base 20 in a separate assembly line in a later process.

Consequently, a manufacturing process for completely assembling the antenna module is very complicated and cumbersome. This has limitations in enhancing work productivity and reducing manufacturing costs.

Moreover, when a structure of the base 20 and design of the radiator 10 are changed to modify the radiator, a mold for pressurizing and perforating the plate-shaped material should be replaced. This replacement job inflicts additional costs and wastes a considerable amount of time, not assuring flexible modification in design of the antenna.

In addition, as shown in FIGS. 1 and 2, the base 20 is a fixed structure assembled between the upper and lower casings 108 and 109, thereby occupying a certain space. Thus the terminal product is limitedly miniaturizable with reduction in an internal space of the upper and lower casings 108 and 109.

SUMMARY OF THE INVENTION

The present invention has been made to solve the foregoing problems of the prior art and therefore an object according to certain embodiments of the present invention is to provide a built-in antenna module of a wireless communication terminal which simplifies a manufacturing process thereof to improve work productivity, saves manufacturing costs, and achieves flexible design modification and miniaturization.

According to an aspect of the invention for realizing the object, there is provided a built-in antenna module of a wireless communication terminal including a substrate disposed inside a terminal body and having a plurality of electronic parts mounted therein; at least one radiator rib integrally extended from the terminal body along a predetermined pattern in accordance with properties of the antenna; and a radiator line made of a conductive elastomer which is dispensed and coated onto an upper end of the radiator rib, the radiator line having an end electrically connected to a feeding part of the substrate.

Preferably, the radiator rib is a perpendicular rib protruded at a predetermined height from an inner surface of an upper casing during injection-molding thereof, the upper casing constituting the terminal body.

Preferably, the radiator rib is a perpendicular rib protruded at a predetermined height from an inner surface of a lower casing during injection-molding thereof, the lower casing constituting the terminal body.

Preferably, the radiator rib has at least one step formed on the upper end thereof, the step having a polygonal cross-section for enabling the radiator line to be formed longer.

Preferably, the radiator rib has at least one step formed on the upper end thereof, the step having a cup-shaped cross-section for enabling the radiator line to be formed longer.

Preferably, the radiator rib comprises a conductive elastomer having a volume resistance of 1 Ωcm to 1000 Ωcm.

More preferably, the conductive elastomer is formed by adding a conductive metal to a non-conductive elastic resin.

More preferably, the conductive elastomer has an elastic strength of Hs 5 to Hs 100.

Preferably, the radiator line has a protrusion protruded from an end thereof corresponding to the feeding part of the substrate, the protrusion being in resilient contact with the feeding part.

Preferably, the feeding part includes an elastic flap having a free end resiliently contacting a predetermined portion of the radiator line and a fixed end fixed to a fixed hole of the substrate.

Preferably, the feeding part includes a contact pin having a free end contacting a predetermined portion of the radiator line and a spring member housed in a cylinder casing so that the contact pin is resiliently supported by elastic force of a predetermined magnitude in an upward direction.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Figure 1:
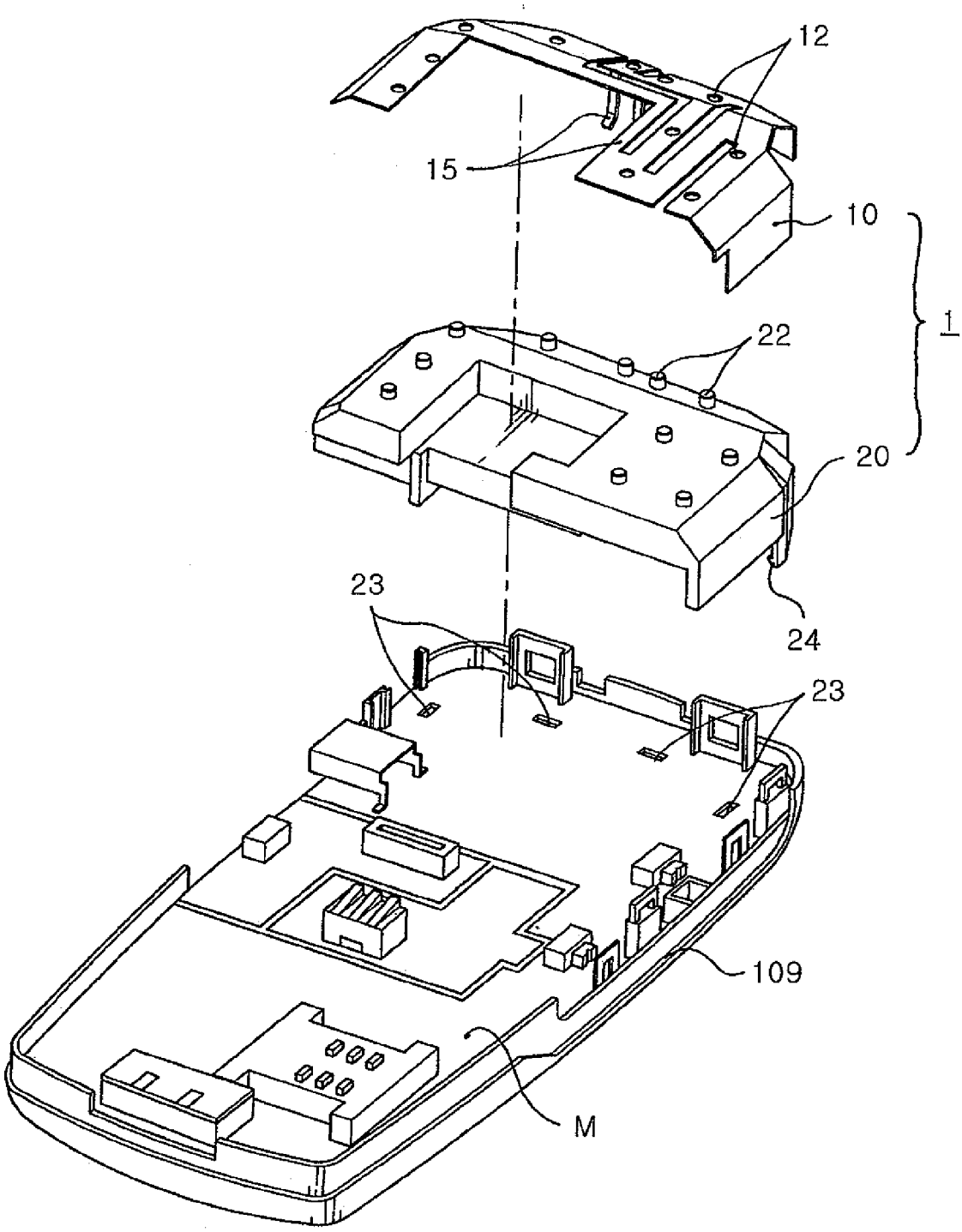
PRIOR ART FIG. 1
FIG. 1 is an exploded view in which a built-in antenna module is provided in a substrate of a wireless communication terminal according to the prior art.
Figure 2:
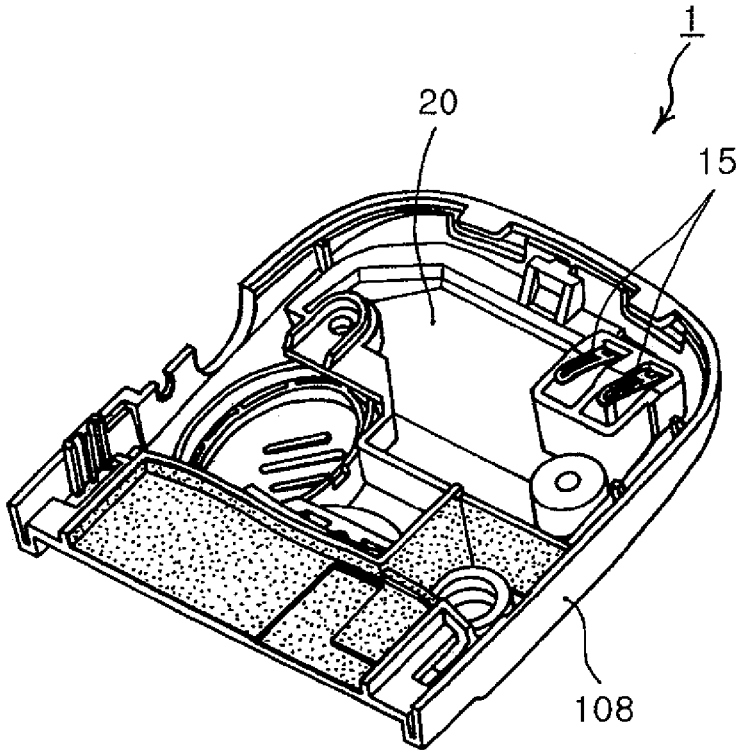
PRIOR ART FIG. 2
FIG. 2 is a perspective view in which a built-in antenna module is assembled onto a lower casing of a wireless communication terminal according to the prior art.
Figure 3:
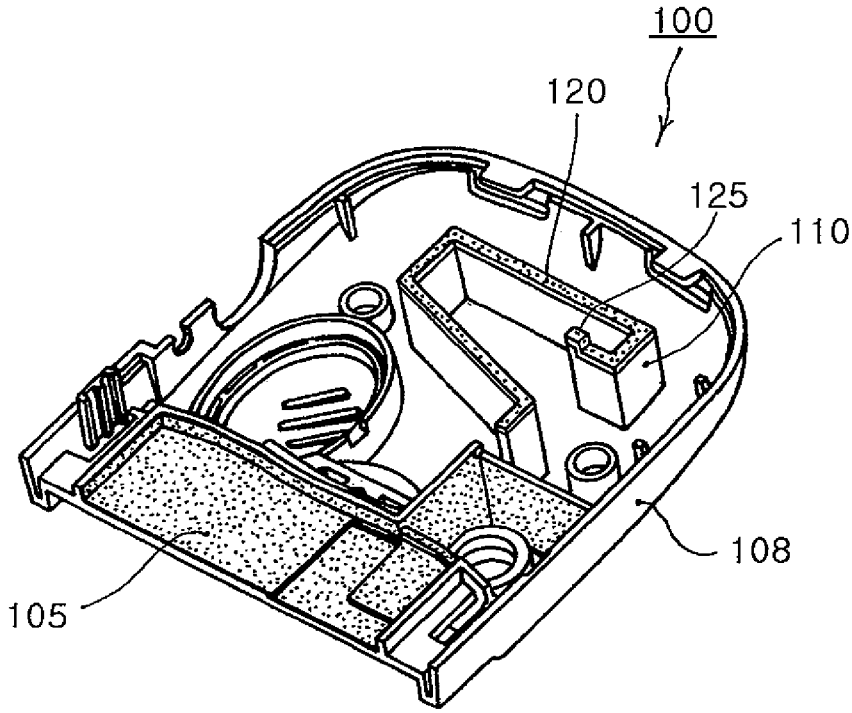
FIG. 3 is a perspective view illustrating a built-in antenna module of a wireless telecommunication terminal according to the invention.
Figure 4:
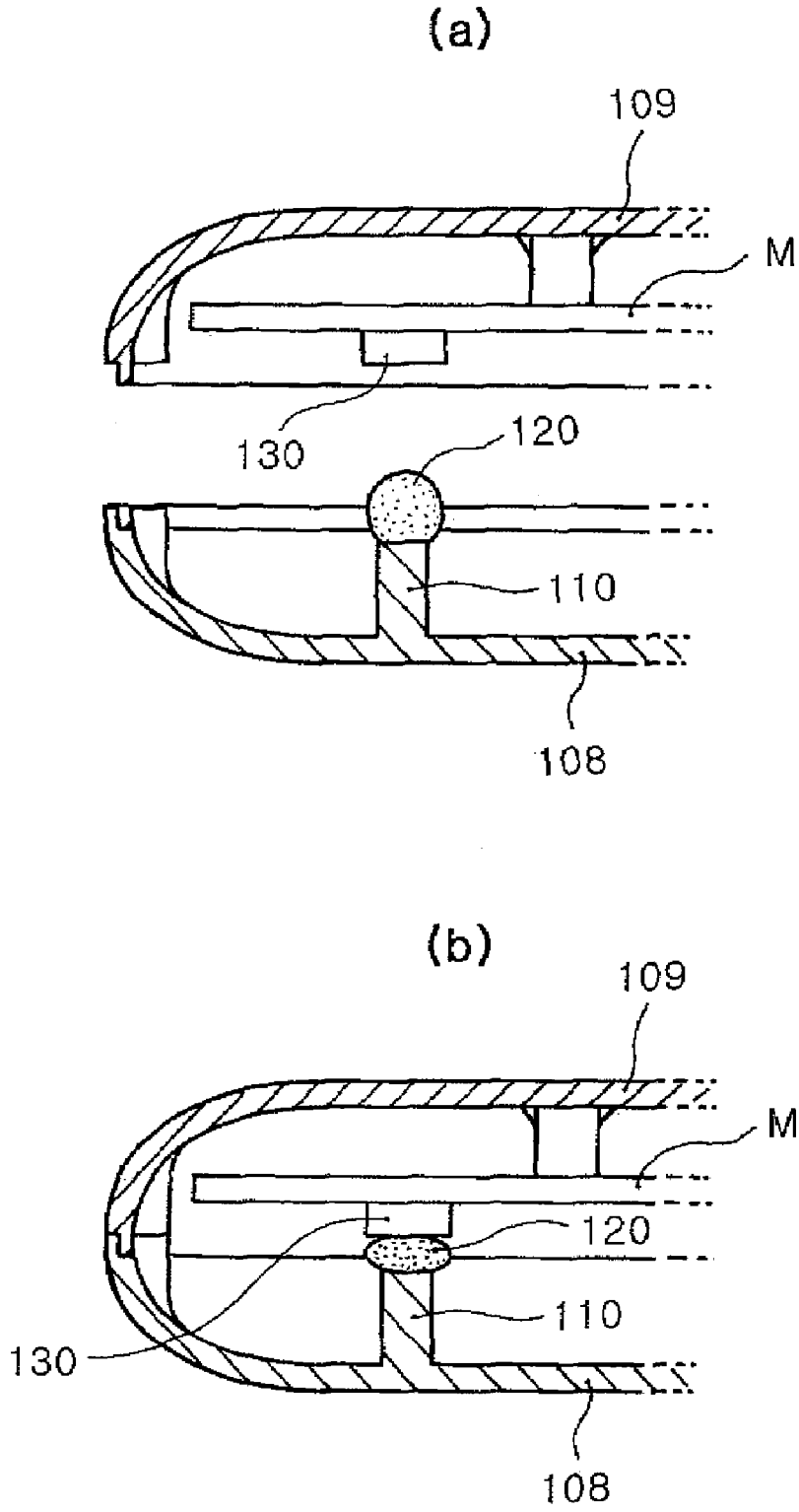
FIGS. 4(*a*)-(*b*) illustrate an assembly process of a built-in antenna module of a wireless telecommunication terminal according to the invention.

FIG. 3 is a perspective view illustrating a built-in antenna module of a wireless telecommunication terminal according to the invention. FIG. 4 illustrates an assembly process of a built-in antenna module of a wireless telecommunication terminal according to the invention.

As shown in FIGS. 3 and 4, in the built-in antenna module 100 of the invention, a radiator is simply and quickly installed thereon without undergoing pressurization and perforation, thereby saving manufacturing costs. The built-in antenna module 100 includes a radiator rib 110, a radiator line and a feeding part 130.

The radiator rib 110 is a vertical structure integrally disposed on an inner surface of an upper or lower casing 108 or 109 which is injection-molded. The upper and lower casings 108 and 109 are assembled together to constitute a terminal body.

The radiator rib 110 is a perpendicular rib member made of a conductive resin. The radiator rib 110 is protruded at a predetermined height from the inner surface of the upper or lower casing 108 or 109 which is injection-molded along a predetermined pattern. The pattern is designed in advance in view of characteristics of the antenna and reception sensitivity.

Also, the radiator line 120 is made of a conductive elastomer which is dispensed (not illustrated) and coated onto an upper end of the radiator rib 110. Here, as just described, the radiator rib 110 is disposed in the upper or lower casing 108 or 109 in accordance with properties of the antenna. This allows a signal to be transmitted and received from the base station.

The conductive elastomer of the radiator line 120 is manufactured by adding a conductive metal element such as gold, silver and bronze to a non-conductive elastic resin such as a silicone rubber. Preferably, in producing the conductive elastomer, a weight ratio of the non-conductive elastic resin is adjusted such that the radiator line 120 has an elastic strength of Hs 5 to Hs 100. Also, preferably, a weight ratio of the conductive metal element is adjusted such that the radiator line 12 has a volume resistance of 1 Ωcm to 1000 Ωcm.

Moreover, preferably, the radiator line 120 has a protrusion 125 on one end thereof corresponding to the feeding part 130 of the substrate M so that the protrusion 125 is in resilient contact with the feeding part 130.

The radiator rib 110 where the radiator line 120 is disposed is made of a non-conductive resin, which is the same material as the injection-molded upper and lower casings 108 and 109. This non-conductive resin has a dielectric constant of at least 1.

Meanwhile, as shown in FIG. 3, the radiator line 120 may be coated on the upper end of the flat radiator rib 110 but not limited thereto. Preferably, the radiator line 120 is formed longer to maximize transmission and reception capabilities of the antenna.

Figure 5:
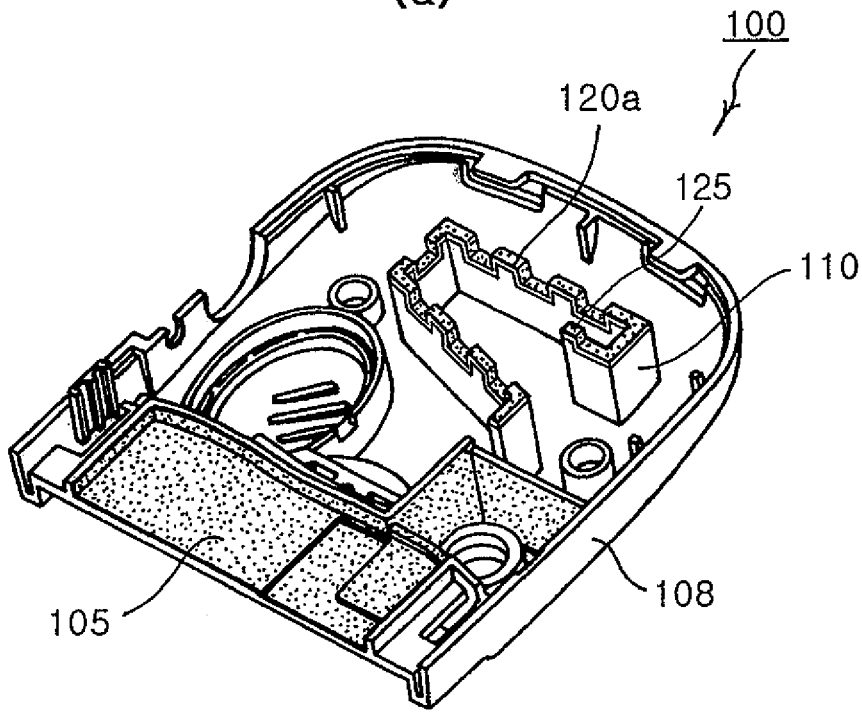
FIG. 5 illustrates a modified embodiment of a radiator line which is employed in a built-in antenna module of a wireless telecommunication terminal according to the invention, in which (a) is a sawtooth radiator line and (b) is a wave radiator line.
Figure 5:
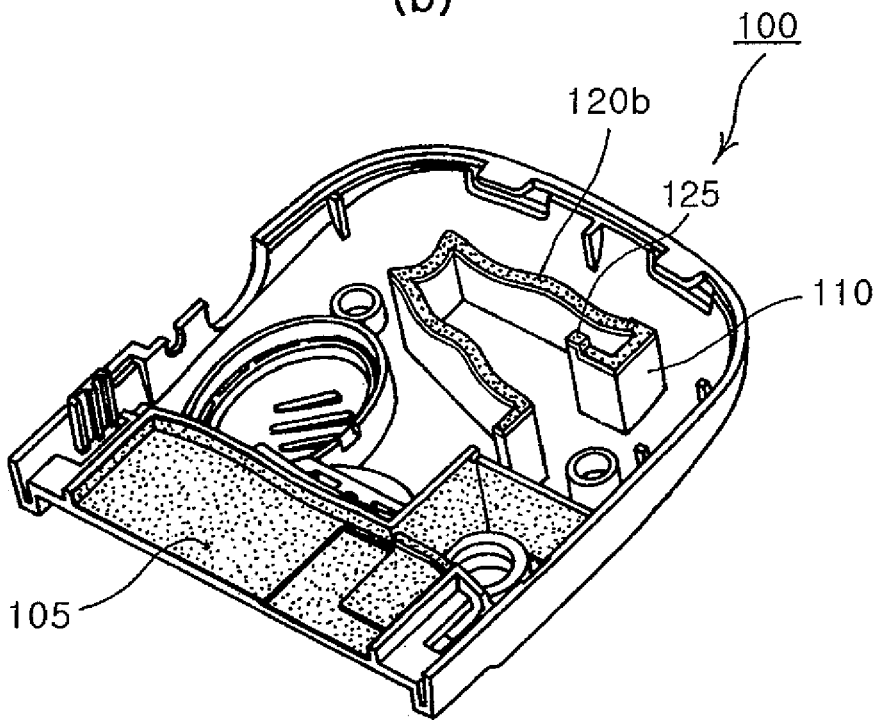

Accordingly, as shown in FIG. 5(*a*), the radiator rib 110 has at least one step having a polygonal cross-section formed on the upper end thereof, thereby forming a sawtooth radiator line 120*a*. Also, as shown in FIG. 5(*b*), the radiator rib 110 has at least one step having a cup-shaped cross-section on an upper end thereof, thereby forming a wave radiator line 120*b*.

The substrate M has at least one feeding part 130 formed thereon corresponding to a side end of the radiator line 120 to be electrically connected to the radiator line 120.

Figure 6:
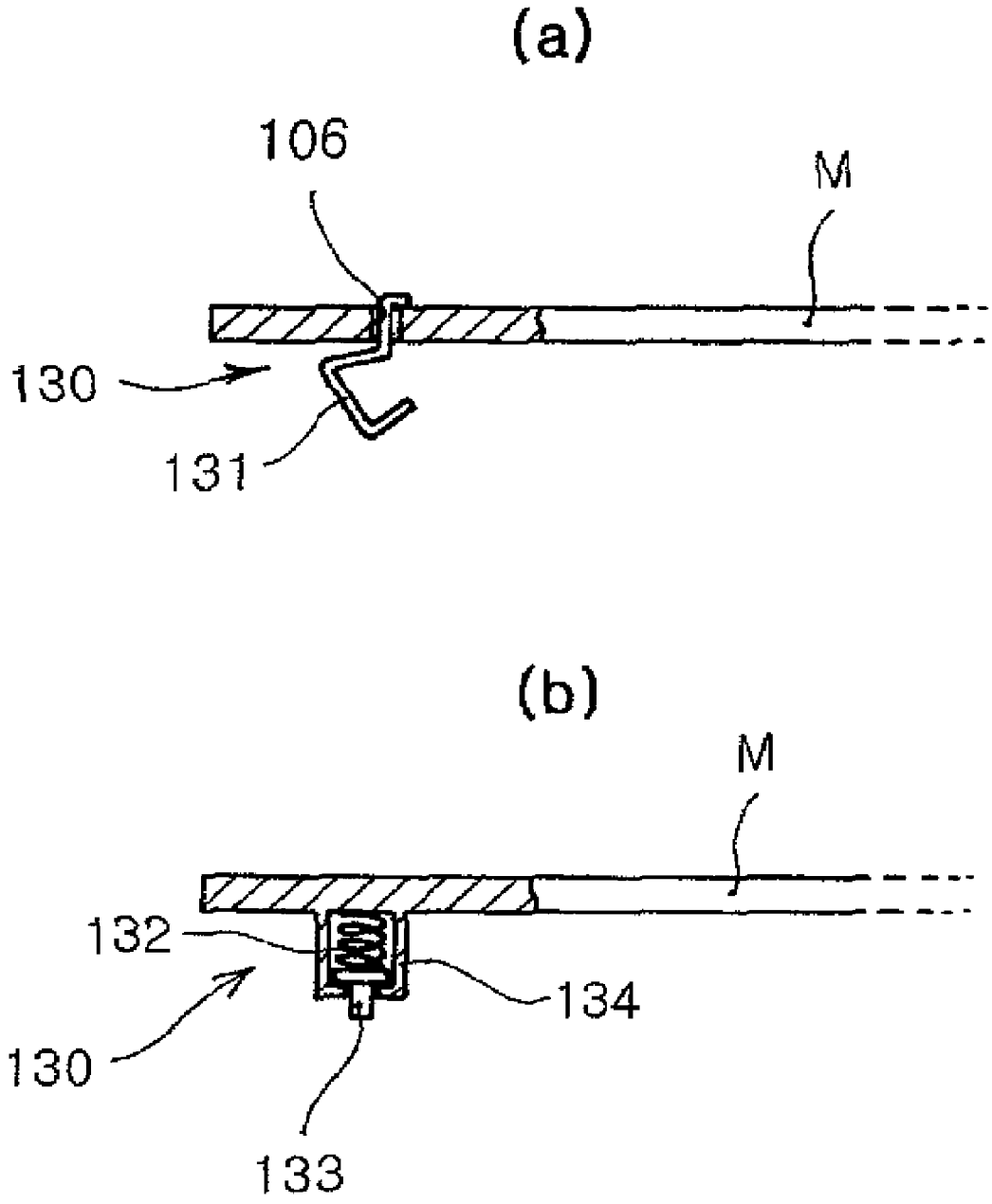
FIG. 6 illustrates an embodiment of a feeding part which is employed in a built-in antenna module of a wireless telecommunication terminal according to the invention, in which (a) is an elastic flap-shaped feeding part and (b) is a Fog pin-shaped feeding part.

As shown in FIG. 6(*a*), the feeding part 130 is structured as an elastic flap 131 in which a free end is in resilient contact with a predetermined portion of the radiator line 120 and a fixed end is fixed in a fixed hole 106 of the substrate M. Alternatively, as shown in FIG. 6(*b*), the feeding part 130 includes a contact pin 133 having a free end contacting a predetermined portion of the radiator line 120 and a spring member 132 housed in a cylinder casing 134 so that the contact pin is resiliently supported by elastic force of a predetermined magnitude in a direction of the radiator line 120.

To configure the antenna module 100 as just described, the radiator rib 120 is an integral perpendicular rib member protruded at a predetermined height from an inner surface of an upper or lower casing 108 or 109 during injection-molding thereof. The upper and lower casings 108 and 109 are injection-molded of a non-conductive resin by a mold (not illustrated) to constitute a terminal body.

The at least one radiator rib 120 is disposed on at least one of the upper and lower casings 108 and 109 corresponding to the feeding part 130 of the substrate M where electronic parts are mounted.

Further, the radiator rib 110 formed during injection-molding of the upper and lower casings 108 and 109 is shaped according to pre-set antenna characteristics and reception sensitivity. The radiator rib 120 may have at least one step having a polygonal cross-section or a cup-shaped cross-section formed on an upper end thereof, thereby enabling the radiator line 120 to be formed longer.

Subsequently, a conductive paint 105 for shielding EMI is coated on an inner surface of the upper and lower casings 108 and 109 or an outer surface of the substrate M to be electrically connected to a ground part (not illustrated) of the substrate M. This shields a harmful external electromagnetic wave from entering the terminal body and militating against electronic products.

With the conductive paint for shielding EMI coated, a dispenser (not illustrated) filled with a conductive elastomer is disposed just over the radiator rib 110 to dispense a liquid conductive elastomer along an upper end of the radiator rib 110. Here, the liquid conductive elastomer is manufactured by combining an elastic resin and a conductive metal element. This allows a radiator line 120 to be formed on the upper end of the radiator rib 110 to radiate a signal to the outside and receive an external signal.

The conductive elastomer dispensed onto the radiator rib 110 is naturally cured or UV-cured. For the natural curing, the conductive elastomer is kept at a room temperature during a predetermined time. Meanwhile, for the UV-curing, the conductive elastomer is irradiated with ultra violet ray to shorten a curing time.

Subsequently, upon curing the radiator line 120 made of the conductive elastomer, the upper and lower casings 108 and 109 are vertically assembled together. Then the substrate M assembled on the lower casing 109 is electrically connected to the radiator line 120 by the feeding part 130.

That is, the protrusion 125 formed on one end of the radiator line 120 corresponds one-by-one to the feeding part 130 of the substrate M so that the radiator line 120 resiliently contacts the feeding part 130.

As shown in FIG. 6(*a*), in a case where the feeding part 130 is the elastic flap 131 connected to the substrate M, the free end of the elastic flap 131 is in resilient contact with and electrically connected to a conductive elastomer corresponding to the protrusion 125 of the radiator line 120, thereby allowing a signal to be transmitted and received.

Moreover, as shown in FIG. 6 (*b*), in a case where the feeding part 130 is structured of a Fog pin-shaped contact pin 133 and a spring member 132 elastically supporting the contact pin, the contact pin 133 has an end in resilient contact with and electrically connected to an end of the radiator line 120, thereby enabling transmission and reception of the signal.

As set forth above, according to preferred embodiments of the invention, a wireless telecommunication terminal has a radiator rib on an inner surface thereof when upper and lower casings of a terminal body are injection-molded. Also, the terminal has a conductive elastomer dispensed on an upper end thereof to contact a feeding part of the substrate. Therefore the invention obviates a need for a cumbersome and complicated process of pressurizing and perforating a plate-shaped material to form a separate radiator, and assemble the radiator on an outer surface of a base and then the base assembled with the radiator onto a casing, as in the prior art. Meanwhile, the invention allows a radiator rib to be integrally formed on an inner surface of the casing and a radiator line to be installed thereon more easily and conveniently. This simplifies a manufacturing process of the antenna module, thereby reducing manufacturing costs and enhancing design flexibility of the antenna.

In addition, according to the invention, a base is not installed in an inner space between the upper and lower casings as in the prior art. This allows the antenna module to occupy significantly less space than the prior art, thereby ensuring the terminal product to be designed in a smaller size.

While the present invention has been shown and described in connection with the preferred embodiments, it will be apparent to those skilled in the art that modifications and variations can be made without departing from the spirit and scope of the invention as defined by the appended claims.

What is claimed is:

1. A built-in antenna module of a wireless communication terminal comprising:

a substrate disposed inside a terminal body and having a plurality of electronic parts mounted therein;

at least one radiator rib integrally extended from the terminal body along a predetermined pattern in accordance with properties of the antenna; and a radiator line made of a conductive elastomer which is dispensed and coated onto an upper end of the radiator rib, the radiator line having an end electrically connected to a feeding part of the substrate.

2. The built-in antenna module according to claim 1, wherein the radiator rib is a perpendicular rib protruded at a predetermined height from an inner surface of an upper casing during injection-molding thereof, the upper casing constituting the terminal body.

3. The built-in antenna module according to claim 1, wherein the radiator rib is a perpendicular rib protruded at a predetermined height from an inner surface of a lower casing during injection-molding thereof, the lower casing constituting the terminal body.

4. The built-in antenna module according to claim 1, wherein the radiator rib has at least one step formed on the upper end thereof, the step having a polygonal cross section for enabling the radiator line to be formed longer.

5. The built-in antenna module according to claim 1, wherein the radiator rib has at least one step formed on the upper end thereof, the step having a cup-shaped cross section for enabling the radiator line to be formed longer.

6. The built-in antenna module according to claim 1, wherein the radiator rib comprises a conductive elastomer having a volume resistance of 1 Ωcm to 1000 Ωcm.

7. The built-in antenna module according to claim 6, wherein the conductive elastomer is formed by adding a conductive metal to a non-conductive elastic resin.

8. The built-in antenna module according to claim 6, wherein the conductive elastomer has an elastic strength of Hs 5 to Hs 100.

9. The built-in antenna module according to claim 1, wherein the radiator line has a protrusion protruded from an end thereof corresponding to the feeding part of the substrate, the protrusion being in resilient contact with the feeding part.

10. The built-in antenna module according to claim 1, wherein the feeding part includes an elastic flap having a free end resiliently contacting a predetermined portion of the radiator line and a fixed end fixed to a fixed hole of the substrate.

11. The built-in antenna module according to claim 1, wherein the feeding part includes a contact pin having a free end contacting a predetermined portion of the radiator line and a spring member housed in a cylinder casing so that the contact pin is resiliently supported by elastic force of a predetermined magnitude in an upward direction.

* * * * *